United States Patent [19]

Noé

[11] 4,171,632

[45] Oct. 23, 1979

[54] METHOD OF AND APPARATUS FOR HOT-ROLLING A THIN METAL SHEET

[75] Inventor: Oskar Noé, Mülheim, Fed. Rep. of Germany

[73] Assignee: BWG Bergwerk- und Walzwerk-Maschinenbau Gesellschaft mit beschränkter Haftung, Duisburg, Fed. Rep. of Germany

[21] Appl. No.: 876,416

[22] Filed: Feb. 9, 1978

[30] Foreign Application Priority Data

Feb. 18, 1977 [DE] Fed. Rep. of Germany ..... 2706943

[51] Int. Cl.[2] ..... B21B 1/26

[52] U.S. Cl. ..... 72/205; 72/161

[58] Field of Search ..... 72/11, 205, 234, 161, 72/226, 227, 199, 366

[56] References Cited

U.S. PATENT DOCUMENTS

| | | | |
|---|---|---|---|
| 3,169,421 | 2/1965 | Bloodworth | 72/11 |
| 3,440,846 | 4/1969 | Scott | 72/205 X |
| 3,453,847 | 7/1969 | Romanauskas | 72/205 X |
| 3,924,428 | 12/1975 | Noé | 72/161 |
| 4,074,555 | 2/1978 | Noé | 72/163 X |

*Primary Examiner*—Milton S. Mehr

*Attorney, Agent, or Firm*—Karl F. Ross

[57] ABSTRACT

A thin metal sheet is produced in a continuous rolling operation by passing the hot workpiece through a succession of size-reducing compression roller stands. Between the furthest downstream stand and the stand immediately upstream therefrom there is provided a stretcher which decreases the workpiece's thickness between 5 and 15%, whereas the furthest downstream rolling stand merely reduces the thickness between 3 and 6%. Thus irregularities in planarity and the like are completely eliminated by the stretcher and the furthest downstream rolling stand serves merely to accurately size the workpiece.

14 Claims, 1 Drawing Figure

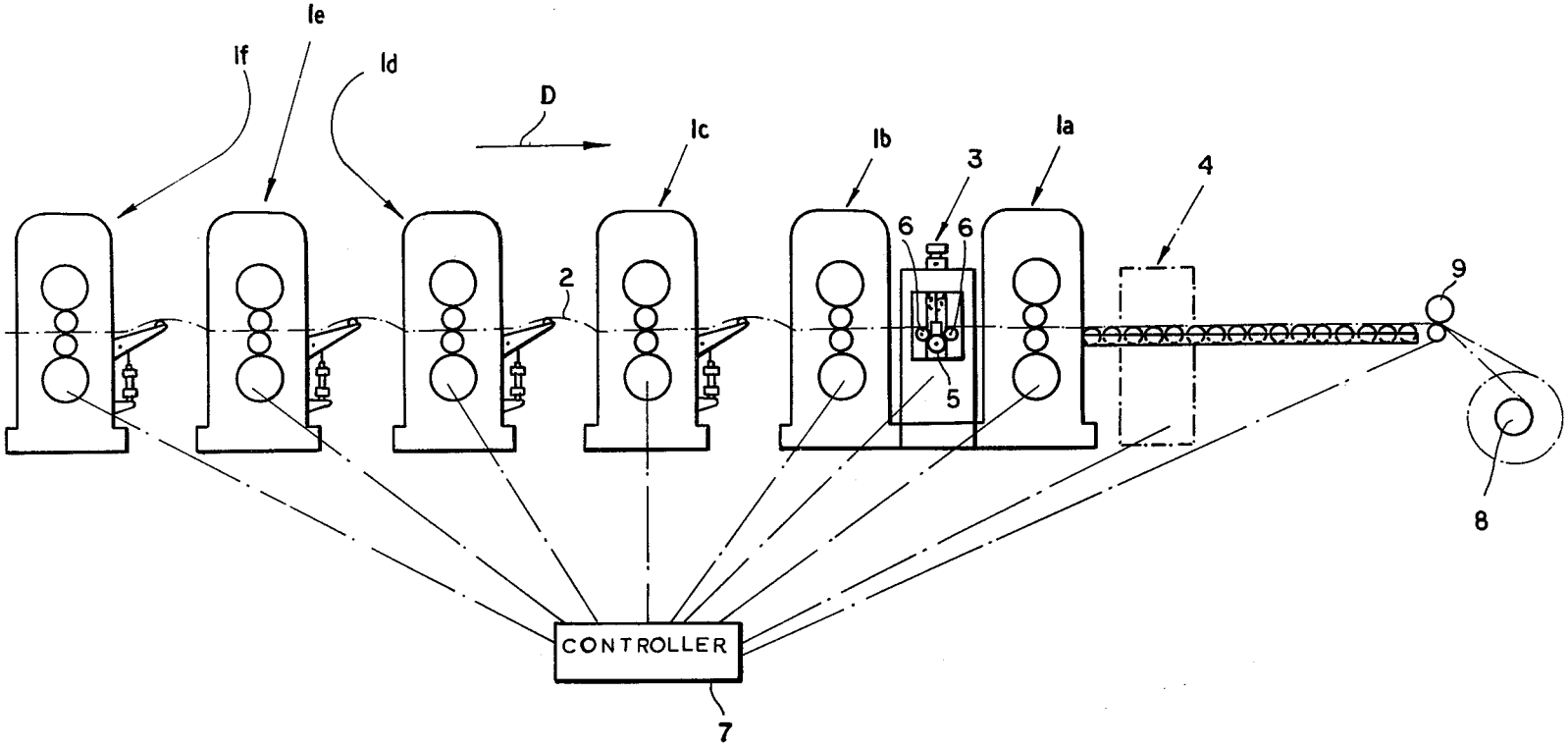
1a
1b
1c
1d
1e
1f
2
3
4
5
6
6
7
8
9
D
CONTROLLER

METHOD OF AND APPARATUS FOR HOT-ROLLING A THIN METAL SHEET

FIELD OF THE INVENTION

The present invention relates to a method of and an apparatus for treating a metal band. More particularly this invention concerns the hot rolling of a relatively thin metal sheet.

BACKGROUND OF THE INVENTION

Flat-rolled steel products fall within the categories of hot-rolled and cold-rolled bands, either constituted as sheets having a width over 300 mm and a thickness of at least 5.8 mm or strips having smaller dimensions. Typical cold-rolled material has a fine surface finish and can be reduced to a very small thickness, whereas hot-rolled material can be produced at substantially lower cost than the cold-rolled material.

With the hot-rolling process a room-temperature coil of a band having a thickness between 6.0 mm and 2.0 mm is first unwound. The band is then pickled or otherwise descaled and heated up to the appropriate recrystallization temperature, above 700° C. It is then run through a plurality of stands of finishing rollers to reduce its thickness. Thereafter the band is again cooled below the recrystallization temperature and passed through finishing rollers which reduce its thickness slightly and give it a good surface finish. The reheating and recooling of the material requires considerable energy, while at the same time the system uses a considerable amount of equipment.

It has been attempted to reduce the thickness of a relatively wide sheet having a width over 600 mm to a thickness of between 0.5 mm and 2.0 mm, normally between 0.7 mm and 1.5 mm, using hot-rolling exclusively. It has been found extremely difficult to maintain the proper temperature in such a sheet so as to produce a band of even width, uniform section, and good planarity. Thus it is normally considered impossible in a hot-rolling operation to reduce the band thickness below 2.0 mm or 1.5 mm at the most. Many attempts to reduce a band by hot-rolling alone to a desired relatively small thickness have proven unsuccessful, even with the use of complex electronic thickness-monitoring and control systems. Frequently the band will curve to one side, so that when subjected to subsequent rolling a fold will be formed. Thus recourse must invariably be had to a combined hot-rolling and cold-rolling system with the hot-rolling reducing the band thickness considerably, then the cold-rolling producing the desirable smooth surface finish and dimensional regularity.

Another disadvantage of the hot-rolling method is that the surface of the band being worked is frequently embossed by the hot-working rollers. Considerable subsequent cold-rolling is necessary to finish such a product and remove the irregularities on its surfaces. Even when this is done the planar anisotropy of the product is often problematic. Thus subsequent working of such sheets, as for instance in stamping or cutting, becomes very difficult in one direction in the plane of the sheet. This is a particular problem when silicon steel sheets are being worked for subsequent use in transformers, motors, or the like. The magnetic anisotropy can greatly reduce the efficiency with which such a plate transmits magnetic forces or currents, so that extreme care must be taken in rolling out sheets for such use. The particular surface formation on the hot-working rollers determine in part the extent of this anisotropy. The production of the desired roller texture is also relatively expensive.

OBJECT OF THE INVENTION

It is therefore an object of the present invention to provide an improved method of and apparatus for treating a metal band.

Another object is to provide such a method and apparatus which allow the relatively thick and wide band to be reduced to a relatively thin strip or sheet having a good crystalline structure and smooth surface.

Another object is to provide such a method and apparatus which operate at relatively low cost and considerable efficiency.

SUMMARY OF THE INVENTION

These objects are attained according to the present invention in an arrangement of the above-described general type wherein the band is hot-rolled, and is longitudinally stretched between the furthest downstream hot-rolling stand and the rolling stand immediately upstream therefrom.

The invention is based on the surprising discovery that the band can be stretched in a single pass through a single stretching unit up to 30%. Such plastic deformation greatly reduces the thickness of the band and otherwise greatly improves its surface. Even bands having nonplanar surfaces or surfaces that extend at an angle to each other are advantageously smoothed with such a system. Furthermore lateral bowing of a band, that is bending in the plane of the band, is completely eliminated, as are any corrugations in the band. What is more, any surface formations resulting from the use of textured hot-working rollers are advantageously eliminated to a large extent by such a stretching operation, so that even silicon-steel bands can be produced with this method for use in transformers, motors, or the like.

According to a further feature of this invention the last rolling stand reduces the thickness of the band by between 3% and 6%, thereby accurately setting a given thickness for the band. Any surface formations resulting from the use of textured hot-working rollers which have not been eliminated by the stretching are completely eliminated by this last sizing step. Since only a relatively minor size reduction is effected at this last sizing step the likelihood of reintroducing any bowing or any other undesirable formations into the workpiece is completely eliminated. In accordance with the invention the sheet or strip workpiece is reduced in thickness by between 5% and 15% during stretching.

In accordance with the present invention the entire process operates continuously while maintaining the workpiece above the recrystallization temperature, that is about 700° C. Hot-rolling normally starts at a temperature of approximately 1200° C., and according to this invention is merely maintained above the recrystallization temperature by working on it so rapidly that it does not have time to cool off down to a temperature below 700° C.

It is also possible in accordance with the invention to introduce further stretching stages into the operation. Such stages may be upstream of the above-mentioned stretcher, and according to this invention one such stage may be provided between the furthest downstream roller stand and the output end of the string.

The method according to this invention is carried out using a plurality of conventional hot-working roller stands, between the furthest downstream two of which is provided a stretcher constituted as a stretch roller and a pair of idler rollers. The extent of stretch imparted to the workpiece, and therefore the amount of thickness reduction, is determined by varying the interengagement depth of the stretch rollers or by varying the tension in the band. When a new workpiece is sent through the system according to the invention the rollers of the stretcher are accelerated up to a peripheral speed equal to the displacement speed of the workpiece, and these rollers are engaged with the workpiece only after it has engaged in the furthest downstream set of size-reducing rollers.

According to further features of this invention the rollers of the stretcher are of a diameter equal to between 75 and 150 times the thickness of the workpiece as it emerges from the next-to-last rolling stand. Such a system can readily reduce a steel workpiece having a thickness up to 6.0 mm to a thickness of between 1.5 mm and 0.7 mm, imparting almost perfectly smooth surfaces to it so that the finished workpiece has the characteristics of a high-quality cold-rolled sheet or strip. Almost perfect planar isotropy is obtained so that the finished product can readily be used in a transformer, dynamo, or other magnetic device. The stretching stage completely eliminates the need for a subsequent cold-working operation.

BRIEF DESCRIPTION OF THE DRAWING

The sole FIGURE of the drawing is a largely schematic view of a treatment installation according to the present invention.

SPECIFIC DESCRIPTION

As shown in the drawing the system according to this invention basically comprises six rolling stands 1*a*–1*f* spaced apart along a workpiece path in a transport direction D and all operated synchronously by means of a common controller 7. Provided between the furthest downstream stand 1*a* and the next closest stand 1*b* is a stretch bender 3 having a vertically displaceable stretch roller 5 and a pair of idler rollers 6. A metal band 2 to be treated passes between the rollers of the stands 1*a*–1*f* and the rollers 5 and 6 of the stretcher 3. It is also possible as shown in the drawing to provide another stretcher 4 downstream of the furthest downstream stand 1*a* and upstream of the takeup rolls 9 and takeup spool 8.

The band 2 has a thickness of substantially above 2.0 mm and a width substantially over 600 mm, and is reduced according to the present invention to a thickness of between 0.7 mm and 1.5 mm. The unit 3 stretches the band 2 so as to decrease the thickness up to 30%, here between 5% and 15%. The last rolling stand 1*a* reduces the thickness between 3% and 6% to accurately size the band 2.

The controller operates the stands 1*a*–1*f* and the stretcher 3 as well as the optional stretcher 4 synchronously. Furthermore this controller 7 operates the takeup rolls 9. The relative operational speeds of these controlled devices establish the desired amount of stretch and thickness of the workpiece 2. Furthermore the controller 7 can set the vertical height of the stretcher 3 and/or of the stretcher 4 so that it lies directly in line with the flanking stands and further guide rollers are unnecessary.

The rollers 5 and 6 of the unit 3 can be exchanged and have diameters of between 75 times and 150 times the thickness of the band immediately downstream of the stand 1*b*.

Although the system is shown here in a one-way rolling string, it is also applicable to a two-way rolling string. For such an arrangement further stretchers 3 and/or 4 are provided which can be used in dependence on the treatment direction. It is also noted that with the system according to this invention, the use of a stretcher 3 considerably reduces the number of compression stages that are needed, so that a substantial saving in first costs is realized while at the same time producing a superior product.

I claim:

1. A method of machining a metallic band having a thickness of less than 2 mm, said method comprising the steps of simultaneously:

conveying said band longitudinally along a path through a plurality of treatment stations from an upstream input end to a downstream output end;

compressing said band at each of said stations between a pair of compression rollers:

maintaining said band in said path above a predetermined hot-working temperature; and stretch bending said band between two of said stations, said band being compressed and stretch bend to such an extent that its thickness at said output end is less than 2.0 mm.

2. The method defined in claim 1 wherein said band is stretched at said one station sufficiently to reduce its thickness by between 5% and 15%.

3. The method defined in claim 2 wherein the thickness of said band is reduced in said furthest downstream station by between 3% and 6%.

4. The method defined in claim 2 wherein said band is stretched longitudinally at more stations than said one station.

5. The method defined in claim 2, further comprising the step of again stretch bending said band while above said predetermined temperature between said furthest downstream station and said output end.

6. The method defined in claim 2 wherein said band is stretch bent between a stretch roller engaging one face of said band and at least one idler roller, engaging the opposite face of said band, said method further comprising the steps of detecting when the downstream end of a new band to be treated is engaged between the rollers of said furthest downstream station and thereafter driving said stretch roller at a peripheral speed substantially equal to the longitudinal travel speed of said band and engaging said stretch roller against said band, said stretch roller being held substantially out of contact with said band until same is engaged between said rollers of said furthest downstream station.

7. The method defined in claim 2 wherein said band is stretch bent between a stretch roller and at least one idler roller, said method further comprising the step of varying the extent of thickness reduction and stretch by varying the relative spacing of said stretch and idler rollers.

8. The method defined in claim 2, further comprising the step of varying the tension on said band in said path to control the extent of thickness reduction and stretch.

9. The method defined in claim 1 wherein said band is stretch bent immediately upstream of the furthest downstream station.

10. An apparatus for treating a metal band at a predetermined temperature above a hot-working temperature, said apparatus comprising:

a plurality of roller stands spaced longitudinally apart along a longitudinally extending treatment path and each having a pair of compression rollers;

means for operating said roller stands for conveying the band to be treated longitudinally therethrough from an upstream input end to a downstream output end the furthest downstream pair of rollers defining a gap of less than 2.0 mm;

means along said path upstream of the furthest downstream stand for stretch bending said band as same is conveyed along said path.

11. The apparatus defined in claim 10, further comprising a second such means for stretch bending between said furthest downstream stand and said output end.

12. The apparatus defined in claim 10, further comprising further means for stretch bending interleaved with said stands.

13. The apparatus defined in claim 10, further comprising means for adjusting the height of said means for stretch bending relative to said stands.

14. The apparatus defined in claim 10 wherein said means for stretch bending includes a stretch roller engaging one face of said band and at least one idler roller engaging the opposite face of said band, said roller having a diameter equal to between 75 times and 150 times the thickness of said band as it emerges from the stand immediately upstream of said means for stretching.

* * * * *